US006148568A

United States Patent [19]

Beasley

[11] Patent Number: 6,148,568

[45] Date of Patent: Nov. 21, 2000

[54] MODULAR TURNTABLE FOR A BUILDING

[76] Inventor: Rex W. Beasley, 837 Traction, Suite 204, Los Angeles, Calif. 90013

[21] Appl. No.: 08/055,382

[22] Filed: May 3, 1993

[51] Int. Cl.[7] ..... E04B 1/346

[52] U.S. Cl. ..... 52/65; 104/44

[58] Field of Search ..... 52/65; 472/29, 472/35; 104/43–46, 47, 40, 35; 108/139, 22; 248/349; 483/18; 414/223; 245/36.1, 37

[56] References Cited

U.S. PATENT DOCUMENTS

| | | | |
|---|---|---|---|
| 706,891 | 8/1902 | Bramhall | 472/29 X |
| 1,772,858 | 8/1930 | Coffey | 104/44 |
| 2,764,783 | 10/1956 | Teller . | |
| 2,823,425 | 2/1958 | Granek . | |
| 3,078,522 | 2/1963 | Anderson . | |
| 3,125,189 | 3/1964 | Graham . | |
| 3,383,810 | 5/1968 | Mola . | |
| 3,388,513 | 6/1968 | Bauer . | |
| 3,395,500 | 8/1968 | Smith . | |
| 3,399,501 | 9/1968 | Rossantan . | |
| 3,491,496 | 1/1970 | Johnston | 52/65 |
| 3,675,378 | 7/1972 | Neumann et al. . | |
| 3,696,805 | 10/1972 | Sweeten et al. . | |
| 3,933,400 | 1/1976 | Helgeson . | |
| 3,941,146 | 3/1976 | Chatard et al. | 52/65 X |
| 4,191,437 | 3/1980 | Funke | 248/349 X |
| 4,644,707 | 2/1987 | Aubourg et al. . | |
| 5,117,596 | 6/1992 | Leslie et al. . | |
| 5,245,929 | 9/1993 | Wertz et al. | 104/35 |

FOREIGN PATENT DOCUMENTS

| | | | |
|---|---|---|---|
| 2942671 | 4/1981 | Germany | 472/29 |
| 0796344 | 1/1981 | U.S.S.R. | 52/65 |

OTHER PUBLICATIONS

Hovair Air Film Vehicle Turntables.

*Primary Examiner*—Beth A. Stephan

*Attorney, Agent, or Firm*—Kelly Bauersfeld Lowry & Kelley, LLP

[57] ABSTRACT

An improved turntable is provided for use in a building, such as in a residential or office environment, wherein the turntable is constructed from an assembly of modular components for facilitated installation within a relatively low profile space. The turntable comprises a plurality of modular, generally pie-shaped panel units of a lightweight skeletal frame construction. The panel units are joined along radial lines of separation by a plurality of wheel units each including a wheel bracket connected to the adjacent pair of panel units, and a pair of elevationally adjustable wheels for shared distribution of loads applied to the panel units. The wheels may in turn be positioned to ride upon an elevationally adjustable track. A traction drive surface is formed on the periphery of the assembled turntable in a position engaged by a drive roller of a low profile drive unit. The assembled panel units may be adapted for installation in an annular array disposed about a building column, and/or for assembly in concentric rings to define a turntable with extended surface area.

35 Claims, 6 Drawing Sheets

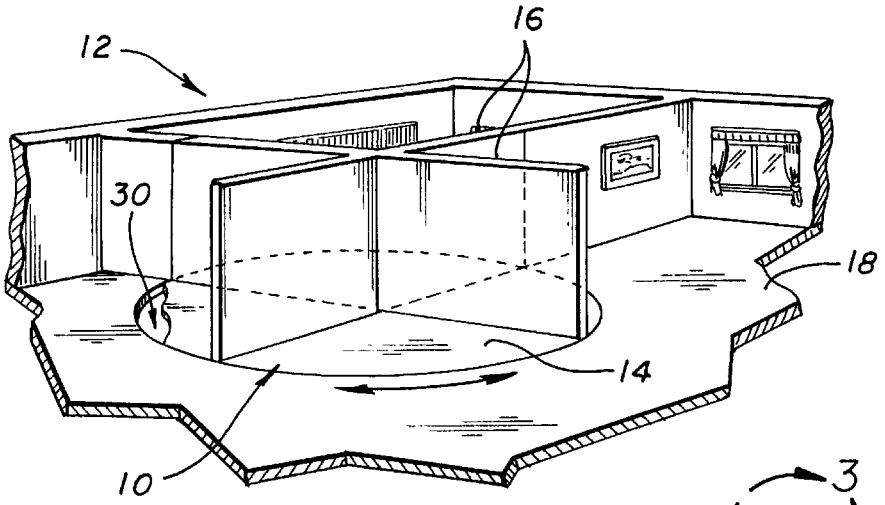
FIG. 1
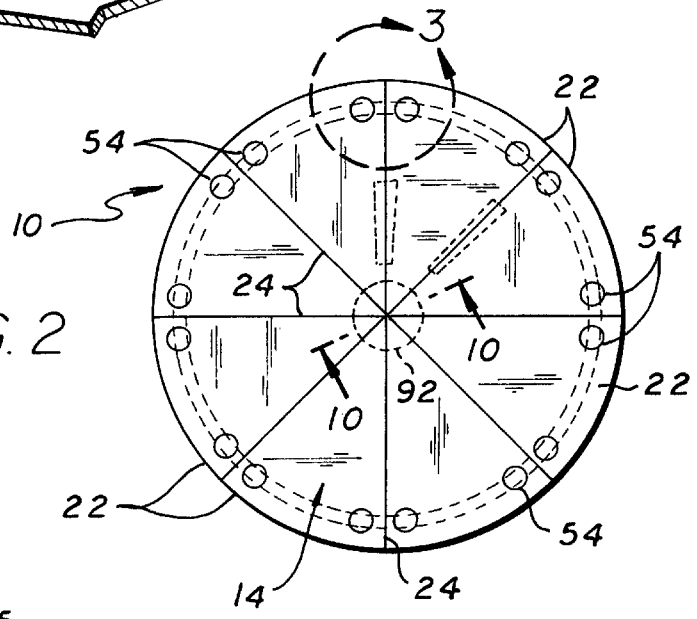
FIG. 2
FIG. 3
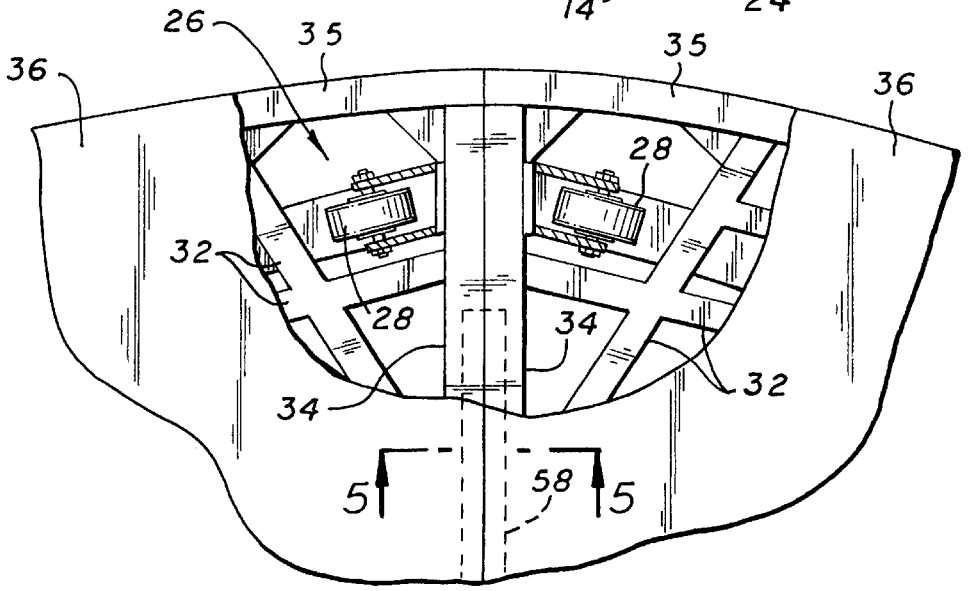

FIG. 4
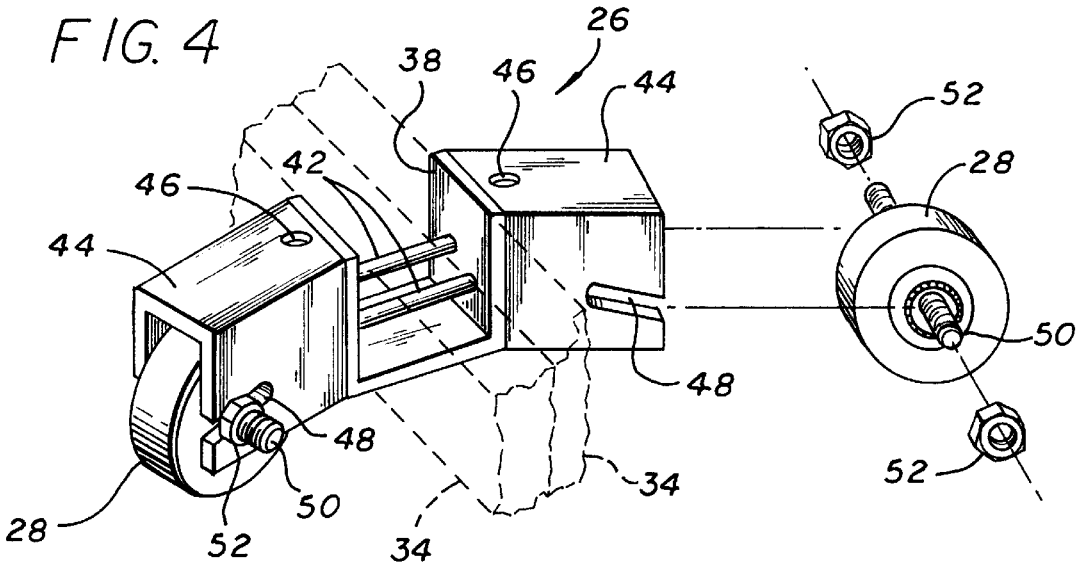
FIG. 5
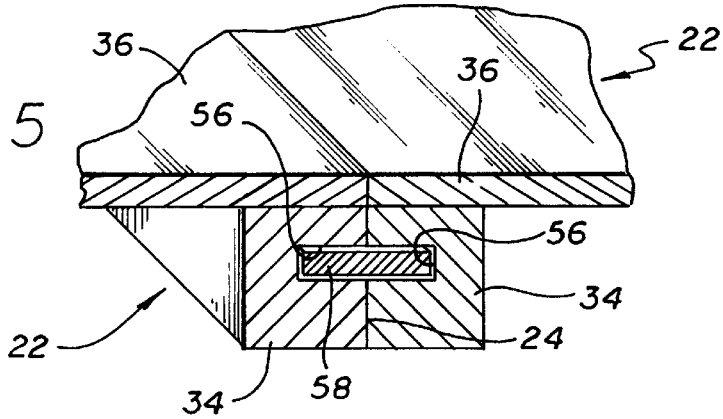
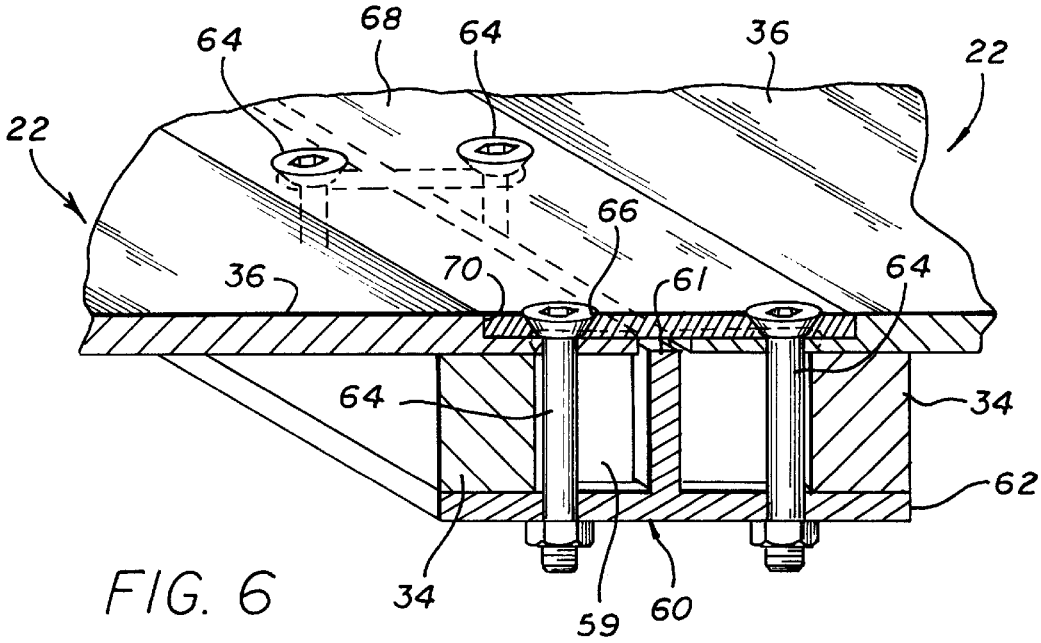
FIG. 6

FIG. 7
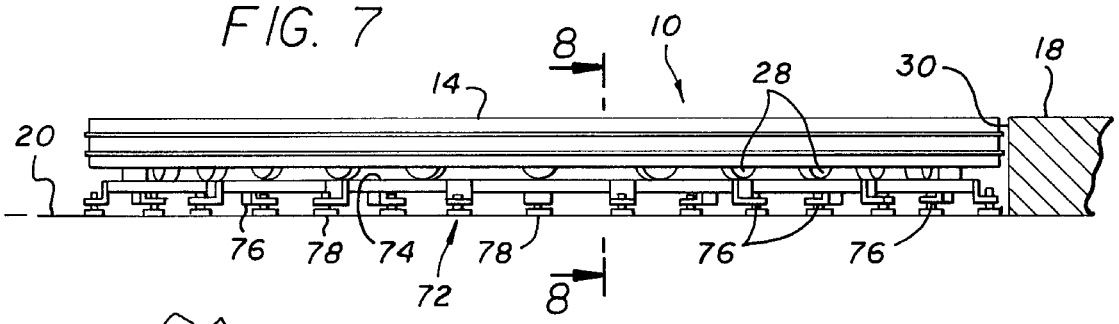
FIG. 9
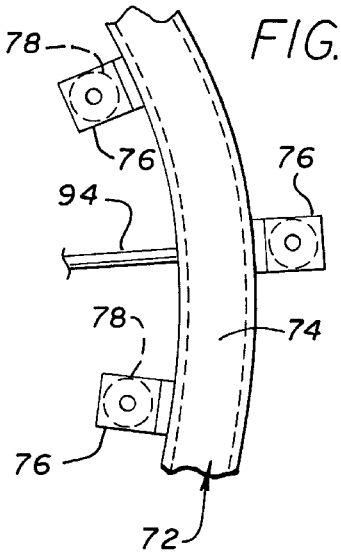
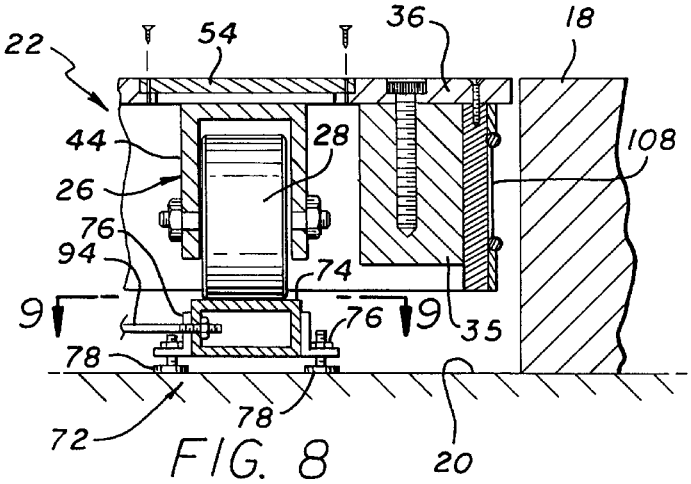
FIG. 8
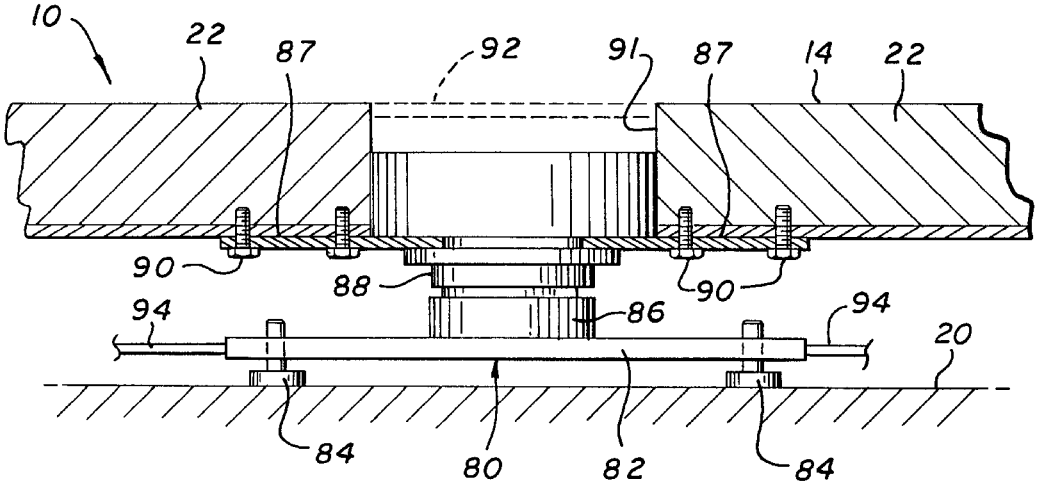
FIG. 10

MODULAR TURNTABLE FOR A BUILDING

BACKGROUND OF THE INVENTION

This invention relates generally to turntables of a type adapted for installation into a building structure to provide a rotatable floor surface. More specifically, this invention relates to an improved turntable of modular design for facilitated and economical installation into a building structure.

Turntables are generally known in the art for installation into a building, such as a residential or commercial structure to provide a rotatable floor surface. For example, rotatable turntables have been employed in restaurants to slowly rotate diners through a circular path and thereby alter the view through exterior windows of the building. See, for example, U.S. Pat. Nos. 3,125,189; 3,388,513; 3,491,496; and 4,817,345. Turntable structures have also been proposed for use in a variety of other commercial establishments, such as medical examination and treatment facilities, multipurpose auditorium structures, and vehicular parking structures. See, for example, U.S. Pat. Nos. 3,383,810; 3,395,500; 3,399,501; 3,675,378; and 3,696,805. Residential turntable structures have also been proposed for rotatably displacing all or part of the structure in a residential dwelling, in accordance with energy efficiency requirements, multipurpose usages of floor space, and the like. See, for example, U.S. Pat. Nos. 2,764,783; 3,078,522; and 2,823,425; 3,933,400; and 4,644,705.

In general terms, prior art turntables for use in a building have comprised relatively complicated and costly systems of customized design for installation into a building structure as a permanent fixture. In this regard, such turntables have typically been installed at the time of initial building construction, with the building structure reflecting substantial and costly nonstandard structural features required to accommodate the size and weight of the custom designed turntable. That is, prior turntables have typically comprised a circular rotatable platform in combination with underlying support structure and related drive means, all of which collectively occupy a vertical space of substantial dimension, and particularly wherein this vertical profile of the turntable exceeds a typical pedestrian step height of approximately four to seven inches. Accordingly, major deviations from standard building construction practices are usually required to construct a recess of nonstandard depth in the building floor in order to orient the turntable in a flush configuration with surrounding floor surfaces. Alternatively, or in addition, major building modifications are normally required to elevate room ceiling height to accommodate turntable installation in a step-up configuration relative to surrounding floor surfaces. Moreover, prior turntables have been relatively heavy, with purportedly lightweight versions still exceeding about twenty pounds per square foot of turntable area, often resulting in a need for structural reinforcement of the building when a turntable is used. Such modifications to standard building structures are, of course, both complex and costly, and frequently preclude installation of a turntable into an existing building structure. Moreover, once the turntable is installed, subsequent removal as may be desired to suit changing occupant requirements can also entail costly modifications to the building structure.

The present invention overcomes the problems and disadvantages encountered in the prior art by providing an improved turntable of a lightweight and modular design adapted for relatively simple and inexpensive installation into and/or subsequent removal from a building structure, without requiring significant or costly customized structural modifications to the building.

SUMMARY OF THE INVENTION

In accordance with the invention, an improved turntable of modular design is provided for facilitated installation into a building to provide a convenient and multipurpose rotatable floor surface. The turntable is constructed from modular components adapted for relatively quick and easy assembly in a low profile space compatible with standard building structural requirements. The turntable can thus be installed relatively economically into a building at a selected location, and, if desired, subsequently removed, all without requiring significant or costly customized modifications to the basic building structure.

In the preferred form, the turntable comprises a plurality of modular, generally pie-shaped panel units adapted for side-by-side assembly along radial inter-unit lines of separation. The individual panel units are rigid yet flex along the lines of separation, thus providing performance of a singularly solid platform. The panel units each have a relatively lightweight, skeletal frame construction. The panel units are interconnected along the associated radial lines of separation. In one preferred form, the connection means includes a plurality of modular wheel units each including a wheel bracket for connecting frame components of the adjacent pair of the panel units along the associated radial line of separation, and preferably at a position near the turntable periphery. Each wheel bracket in turn supports a pair of wheels for shared distribution of loads applied to the adjacent and now-interconnected panel units during normal turntable use. The wheels are elevationally adjustable to permit fine tuning of horizontal turntable orientation, with access plates being removably mounted on the panel units to permit convenient maintenance and post-assembly access to the elevationally adjustable wheels. In the preferred form, the wheels of the multiple wheel units are aligned in a circular array for riding upon an underlying circular and elevationally adjustable wheel track.

A traction drive surface is mounted on the periphery of the assembled turntable, preferably in a removable manner to permit periodic replacement thereof. The traction drive surface is positioned for engagement by a rotatably driven drive roller of a modular drive unit mounted at a selected and convenient location at the periphery of the turntable. In accordance with one aspect of the invention, the wheel units are mounted in positions substantially recessed into the associated panel units, thereby providing a low profile turntable assembly which can be designed to fit within a typical pedestrian building step-height of approximately four to seven inches. The drive unit has a corresponding low profile configuration.

The assembled panel units are centrally supported on a central bearing unit which in turn includes elevational adjustment me ans. In one form, the central bearing unit cooperates with the assembled panel units to define a circular turntable surface area. In an other form, the central bearing unit is adapted for mounting about a pre-existing vertical column in a building, to support the panel units in annular array defining an annular turntable surface disposed about the building columns. In another alternative form, the modular panel units can be provided in assembled concentric rings to provide a circular or annular turntable structure of extended surface area.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented and somewhat schematic perspective view illustrating a turntable embodying the novel features of the invention and depicted as installed into a residential dwelling;

FIG. 2 is a top plan view of the turntable, shown somewhat in schematic form;

FIG. 3 is an enlarged fragmented plan view of a portion of the turntable, corresponding generally with the encircled region 3 of FIG. 2, and broken away to illustrate internal turntable construction details;

FIG. 4 is an enlarged exploded perspective view illustrating a modular wheel unit for interconnecting adjacent modular panel units of the turntable;

FIG. 5 is an enlarged fragmented vertical sectional view taken generally along the line 5—5 of FIG. 3, and illustrating one preferred form for interconnecting adjacent panel units along a radial line of separation therebetween;

FIG. 6 is an enlarged fragmented vertical sectional view generally similar to FIG. 5, but depicting an alternative preferred form for interconnecting adjacent panel units;

FIG. 7 is an elevational view, shown somewhat in schematic form, illustrating the assembled turntable and associated wheel units installed for rotatable displacement on an elevationally adjustable wheel track;

FIG. 8 is an enlarged fragmented vertical sectional view of a portion of the assembled turntable and wheel track, taken generally on the line 8—8 of FIG. 7;

FIG. 9 is an enlarged fragmented horizontal sectional view taken generally on the line 9—9 of FIG. 8;

FIG. 10 is an enlarged fragmented vertical sectional view, shown somewhat in schematic form, taken generally on the line 10—10 of FIG. 2, and illustrating one preferred form of a modular central bearing unit;

DETAILED DESCRIPTION OF THE PREFERRED EMBODIMENTS

Figure 11:
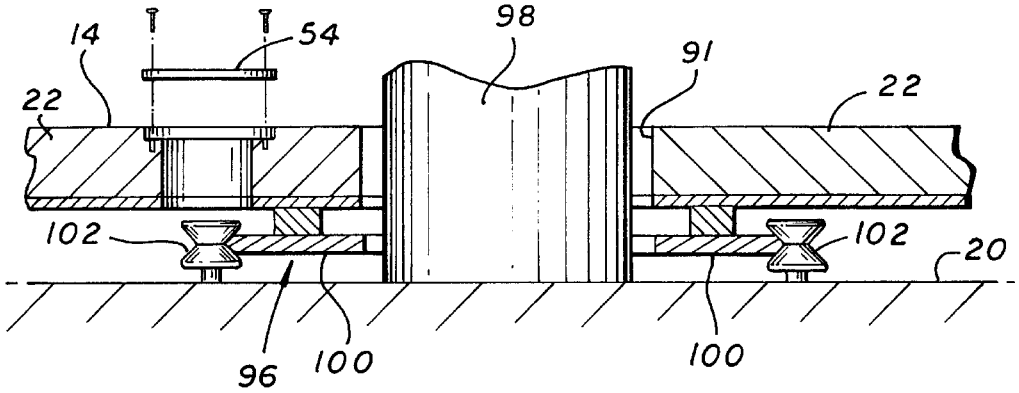
FIG. 11 is an enlarged fragmented vertical sectional view similar to FIG. 10, and depicting an alternative preferred form of a modular central bearing unit.

As shown in the exemplary drawings, an improved turntable of modular construction referred to generally in FIG. 1 by the reference numeral 10 is provided for installation into a building 12, such as in a residential dwelling as depicted in FIG. 1. The turntable 10 provides a rotatable floor surface 14 which may additionally support wall segments 16 and/or other items such as furniture (not shown), etc. In use, the turntable 10 is selectively rotatable to displace the floor surface 14 within the building, relative to a surrounding floor surface 18, for purposes of accommodating selected multipurpose uses. The turntable 10 is constructed from modular components adapted for facilitated and cost-efficient installation into and/or subsequent removal from the building 12, all without requiring major or substantial customized structural changes to the building.

In general terms, the modular turntable 10 of the present invention is constructed from relatively lightweight components which can be delivered to and assembled within the building 12, subsequent to initial construction of the building structure. In assembled form, the turntable 10 has a relatively low profile geometry, preferably on the order of six inches or less, for compatibility with standard step-up or step-down structures. Moreover, the assembled turntable includes load distribution features for supporting the turntable at a large plurality of support points, thereby minimizing structural point loading which would otherwise require building modifications to accommodate turntable mass. The turntable is adapted for fine-tuned elevational adjustments and possesses a high degree of structural rigidity with sufficient inter-module flex to achieve smooth-running and stable operation with respect to a standard support substrate 20 (FIG. 7), such as a concrete slab which typically exhibits minor deviations from a true horizontal plane. Moreover, the modular turntable may be assembled in several different configurations suited individually to the building structure and desired turntable function.

As shown in FIG. 2, the turntable 10 comprises an assembled plurality of modular, generally pie-shaped panel units 22. The panel units 22 are connected along radial lines of separation 24 to define the circular floor surface 14. Each adjacent pair of the panel units 22 is interconnected near the turntable periphery by a modular wheel unit 26 (FIG. 3) having a pair of support wheels 28 disposed on opposite sides of the radial line of separation for shared load distribution of the adjacent panel units 22. In accordance with one primary aspect of the invention, the modular wheel units 26 are nested substantially within the low profile space of the panel units 22, thereby providing an overall low profile turntable construction which, in a typical installation, will fit within a circular step-down recess 30 (FIG. 1) of typical approximate four to seven inch. In this regard, the panel units 22 have a lightweight skeletal frame construction defined by an internal framework of skeletal support members 32 (FIG. 3) in combination with radial support beams 34 extending along the opposite edges thereof. A suitable floor skin 36 is also provided on at least the top surface of each panel unit, wherein the floor skin 36 cooperates with adjacent panel units to define the rotatable circular floor surface 14 upon which finish materials such as carpeting and the like (not shown) may be installed.

Each modular wheel unit 26 as shown in the illustrative drawings comprises a wheel bracket 38 (FIG. 4) having a central, generally U-shaped cavity for seated reception of adjacent radial support beams 34 of an adjacent pair of the panel units 22. Cross bolts 42 are provided for securely connecting the wheel bracket 38 to the beams 34, and for securely fixing the adjacent beams 34 with respect to each other, while permitting some relative flex between the connected units. Wheel support shrouds 44 project outwardly in opposite directions from the bracket 38, and include access ports 46 to permit access to bolt heads and nuts (not shown) associated with the cross bolts 42.

The wheel support shrouds 44 of each modular wheel unit 26 are designed for elevationally adjustable mounting of a pair of the support wheels 28. More specifically, as shown best in FIG. 4, each wheel support shroud 44 includes elevationally inclined mounting slots 48 for receiving the axles 50 of a corresponding pair of the support wheels 28. Appropriate positioning of the wheel axles 50 along the mounting slots 48, and corresponding tightening of axle nuts 52, permits fine-tuned elevational adjustment of each support wheel 28 with respect to the assembled modular panel units 22. As shown in FIG. 2, removable access plates 54 are conveniently provided near the periphery of each panel unit 22 to accommodate access to the underlying wheel unit 26 for purposes of installation and corresponding elevational adjustment of the support wheels 28. Alternately, other wheel mounting configurations may be used, such as mounting a pair of the wheels 28 on each shroud 44 in installations where added wheel support may be necessary or desirable.

FIG. 5 illustrates additional connection means for coupling adjacent panel units 22 along the radial line of separation 24 disposed therebetween. The illustrative connection means comprises aligned keyway channels 56 formed in the outboard faces of the adjacent radial support beams 34, with a press-fit key 58 engaged within said channels 56 to bridge the separation line 24 between the adjacent panel units. For ease of assembly, the keyway channels 56 defined by each adjacent pair of support beams 34 have a triangular or pie-shaped configuration to permit pressed-fitted insertion of a matingly shaped key 58. With such triangular or pie-shaped construction, the last one of the plurality of panel units 22 may be assembled quickly and easily between a corresponding pair of already-assembled panel units, with the associated key 58 pressed into the keyway channels 56 from the periphery of the assembled turntable. In this regard, although the key 58 is shown (FIG. 3) in a fully inserted position disposed radially inward of the corresponding wheel unit 26 (FIGS. 3 and 4), it will be understood that the keyway 56 and the key 58 may extend to the turntable periphery provided that interference with the cross bolts 42 (FIG. 4) is avoided.

FIG. 6 illustrates an alternative clamp means for interconnecting the adjacent panel units 22, in lieu of the keyway structure of FIG. 5. As shown in FIG. 6, a rigid T-shaped support beam 60 is inverted and oriented with a vertical leg 61 disposed circumferentially between the adjacent beams 34 of the two panel units 22. The horizontal leg 62 of the T-beam 60 underlies the two panel units, bridging across the radial line of separation. Mounting bolts 64 are passed downwardly through open-sided slots 59 in the radial support beams 34, for secure clamping attachment to the horizontal leg 62 of the T-beam 60, on opposite sides of the separation line. In the preferred form, these mounting bolts 64 include flat-surfaced heads seated within mating counterbores 66 of a rigid cover plate 68, wherein the cover plate 68 is nested in turn within a matingly shaped recess 70 formed in the upper edges of the panel units 22.

The thus-assembled turntable 10, including the modular panel units 22 and corresponding plurality of interconnecting wheel units 26, is preferably mounted onto a wheel track 72 installed within the turntable recess 30 of the building. This wheel track is shown in more detail in FIGS. 7–9 and comprises a circular track surface 74 defined by stock of rectangular cross section or other shape such as a u-shaped geometry, formed from a suitable material such as metal or plastic. The diametric size of the wheel track 72 is selected to correspond with the diametric position of the support wheels 28, such that the wheels 28 ride upon the track surface 74 as the turntable is rotated. A plurality of L-shaped adjustment brackets 76 are mounted at regularly spaced intervals along the wheel track 72 and include elevational adjustment screws 78 threaded through horizontal legs thereof to permit fine-tuned horizontal adjustment of the track surface 74 relative to the supporting substrate 20.

The radial position of the wheel track 72 is fixed relative to the turntable 10, without requiring permanent attachment of the wheel track 72 or the turntable 10 to the building structure. More particularly, as shown in FIG. 10, a central bearing unit 80 is mounted on the substrate 20 at a selected position, and in a predetermined horizontal orientation. The bearing unit 80 includes a support platform 82 positioned on the substrate 20 by means of a circumferentially spaced array of elevational adjustment support screws 84. The support platform 82 in turn carries a bearing block 86 for rotatably supporting a rotatable bearing member 88 about a vertical axis constituting the center of rotation for the turntable. This rotatable bearing member 88 includes a bearing plate 87 connected by bolts 90 or the like to radially inner edges of the assembled panel units 22. In the preferred form, the radially inner edges of the assembled panel units 22 define a central opening 91. This cavity allows for utility lines such as electrical or plumbing by means of appropriate slip-joint hardware or the like. A trim plate 92 is conveniently provided over the bearing unit 80, to provide an uninterrupted continuation of the circular floor surface 14 defined by the turntable 10. A plurality of at least three and preferably four or more connecting rods 94 project radially outwardly from the bearing platform 82 (FIG. 10) for secure attachment to the underlying wheel track 72 (FIGS. 8 and 9), thereby securely interconnecting the wheel track 72 with respect to the overlying rotatable turntable 10.

FIG. 11 shows an alternative form of a central bearing unit 96 adapted for mounting of the turntable 10 about a pre-existing vertical column 98 of a building. In this version, the central bearing unit 80 comprises an annular bearing plate or ring 100 suspended from the radial inner periphery of the assembled panel units 22, wherein an outer margin of the bearing ring 100 is rollingly engaged within a circumferential array of bearing rollers 102. These bearing rollers 102 are desirably attached to the substrate 20 in any suitable manner and may be conveniently accessed by an overlying access plate 54 formed in one or more of the individual panel units 22. With this construction, the modular panel units 22 can be assembled to provide a rotatable floor surface 14 of annular shape, which is rotatable about the building column 98, with the turntable being rotatable in appropriate increments to permit access to each bearing roller 102 as may be required during installation or for subsequent maintenance. A wheel track 72 and related tie rods 94 are also desirably provided, although such structure is not shown in FIG. 11.

Figure 12:
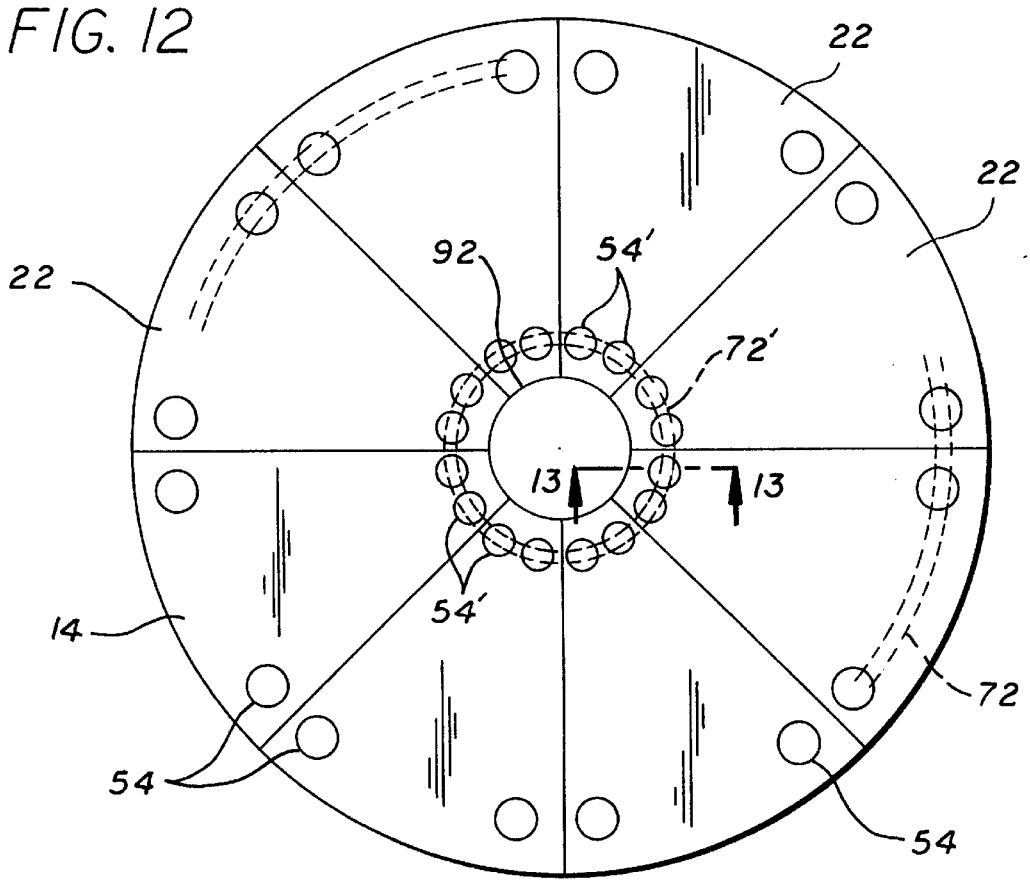
FIG. 12 is a top plan view generally similar to FIG. 2, and illustrating a further alternative preferred form of the modular turntable assembly.
Figure 13:
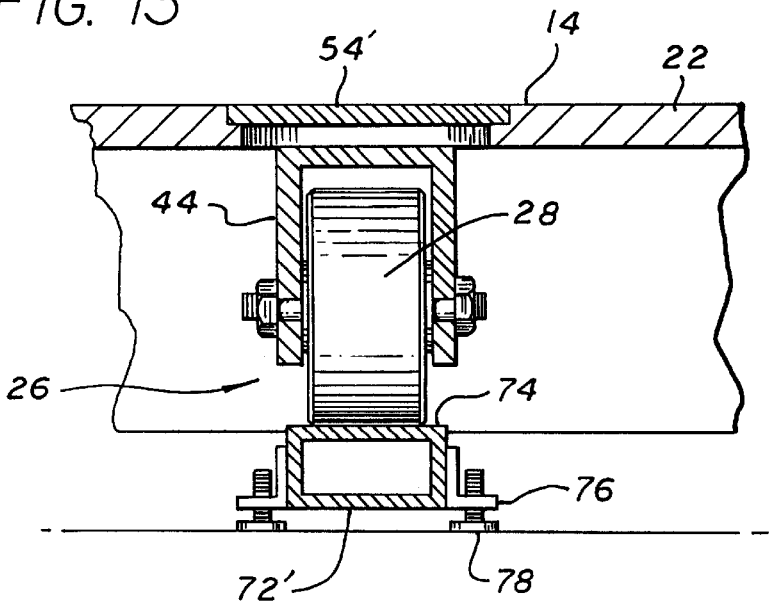
FIG. 13 is an enlarged fragmented vertical sectional view taken generally on the line 13—13 of FIG. 12.

Another alternative embodiment of the invention is shown in FIGS. 12 and 13, wherein additional wheel units 26 may be installed in a circular pattern near the radially inner periphery of the assembled panel units 22. In this embodiment, modular wheel units corresponding with those shown and described in FIGS. 3 and 4 are mounted onto the radial beams 34 of adjacent panel units, with appropriate access being provided through additional cover plates 54'. This inner ring of wheel units 26, and the support wheels 28 provided thereby, is associated with an additional, inner wheel track 72' which corresponds in construction with the wheel track 72 described in FIGS. 7–9. The inner wheel track 72' can be tied to the outer wheel track 72 by means of tie rods 94 (not shown). It will also be understood that this embodiment may be used in a center column application, as previously described with respect to FIG. 11.

Figure 14:
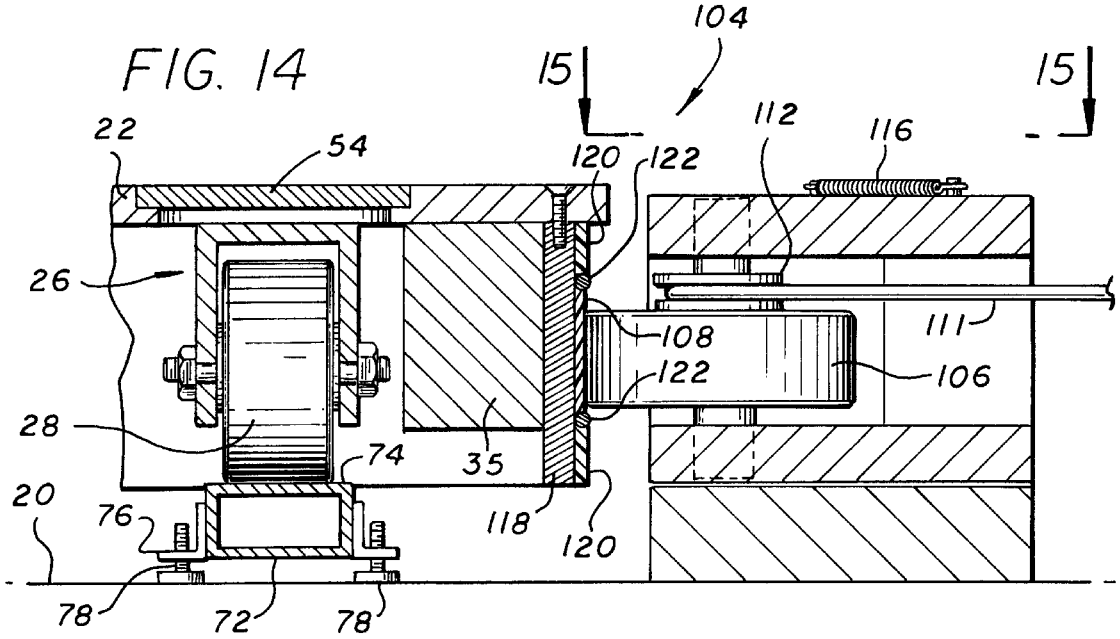
FIG. 14 is an enlarged fragmented vertical sectional view illustrating a modular drive unit in operative engagement with the periphery of the assembled turntable.
Figure 15:
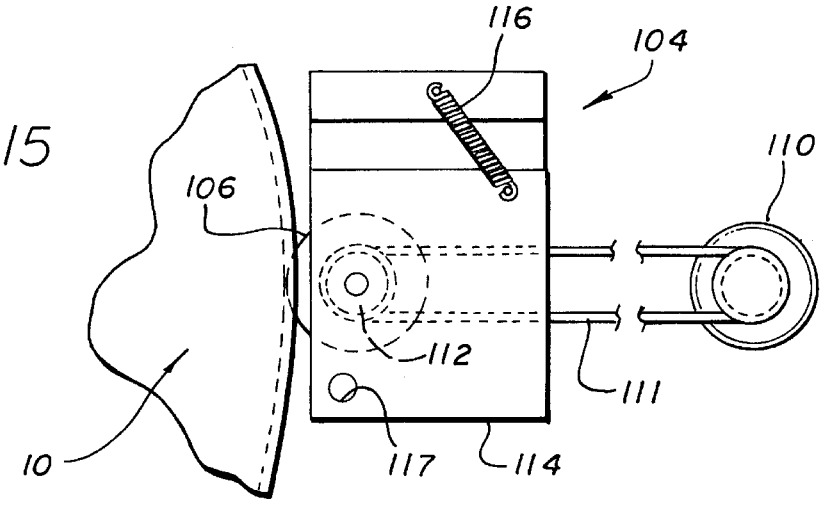
FIG. 15 is an enlarged fragmented plan view of the modular drive unit, taken generally on the line 15—15 of FIG. 14.

FIGS. 14 and 15 illustrate a modular drive unit 104 of low profile configuration, for rotatably and reversibly driving the turntable 10. As shown, the drive unit 104 is installed at a selected position disposed about the turntable periphery, and includes a drive roller 106 engaged with a traction surface 108 on the periphery of the assembled turntable. The drive roller 106 may be driven from a reversible drive motor 110 by means of a drive belt 111 and pulley 112, with the drive roller 106 being carried on a swing arm 114 which is biased by a spring 116 for spring-loaded pivoting about a pivot axis 117. The spring 116 urges the swing arm 114 in a direction to carry and retain the drive roller 106 in traction drive engagement with the turntable traction drive surface 108.

The traction drive surface 108 conveniently comprises a friction drive tread or other selected roughened surface adapted for positive driving engagement by the drive roller 106. One preferred traction drive surface material comprises a circumferentially mounted strip of traction tread marketed by 3M Company, Minneapolis, Minn. under the name Safetywalk. This traction tread material may be mounted conveniently and in a removable manner by wrapping the traction material circumferentially about a base ring 118 of PVC plastic or the like, which is pre-installed about and mounted to a peripheral rim beam 35 of each panel unit 22. In this regard, the rim beams 35 of the assembled panel units cooperatively provide a sturdy peripheral structure, and may be interconnected to provide a rigid full-circle backstop support for the base ring 118. The tread material 108 is disposed vertically between guide or alignment strips 120, with circumferential cables 122 being drawn tight to pinch and retain the traction tread 108 on the periphery of the turntable. With this construction, in accordance with traction drive material wear over an extended use period, the traction drive material may be periodically changed without requiring substantial modification to the turntable structure.

Figure 16:
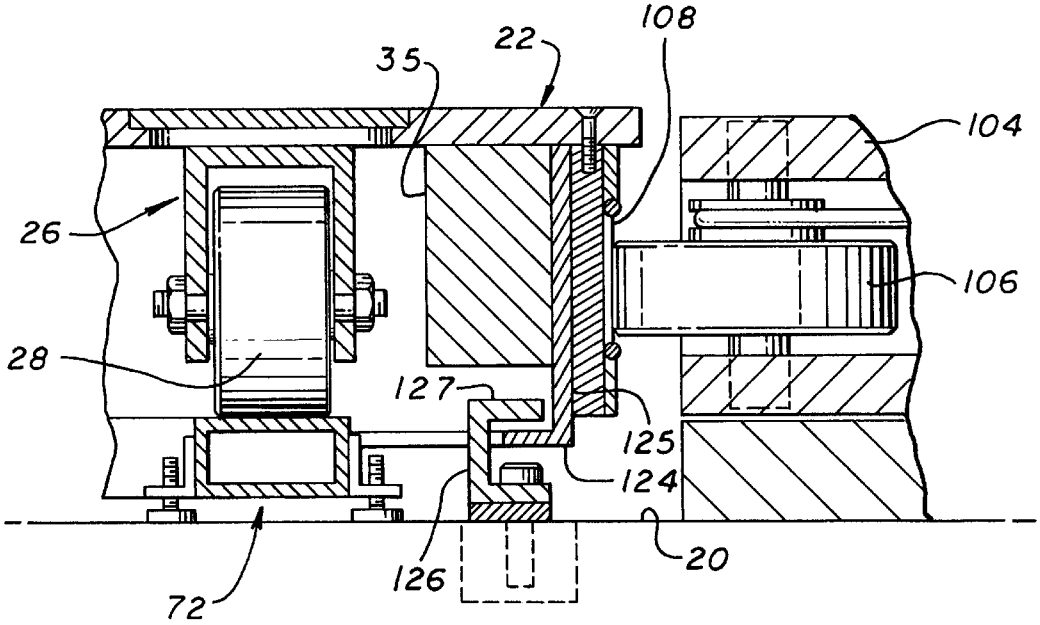
FIG. 16 is an enlarged fragmented vertical sectional view similar t o FIG. 14, and illustrating an alternative form of the invention to include seismic tie-down structure.

FIG. 16 illustrates an alternative embodiment of the invention, wherein seismic tie-down means are provided for restraining and stabilizing the turntable in the event of seismic activity. This tie-down means comprises an inwardly radiating lip 124 on a tie-down bracket 125 mounted at the peripheral edge of each unit 22. This inwardly radiating lip 124 is engaged by a plurality of U-shaped tie-down clamps 126 which may be secured to the substrate 20 at appropriate intervals around the turntable periphery. These tie-down clamps 126 include outwardly radiating upper lips 127 which overlie the lip 124 on the turntable, to effectively prevent substantial vertical displacement of the turntable in the event of seismic activity.

Figure 17:
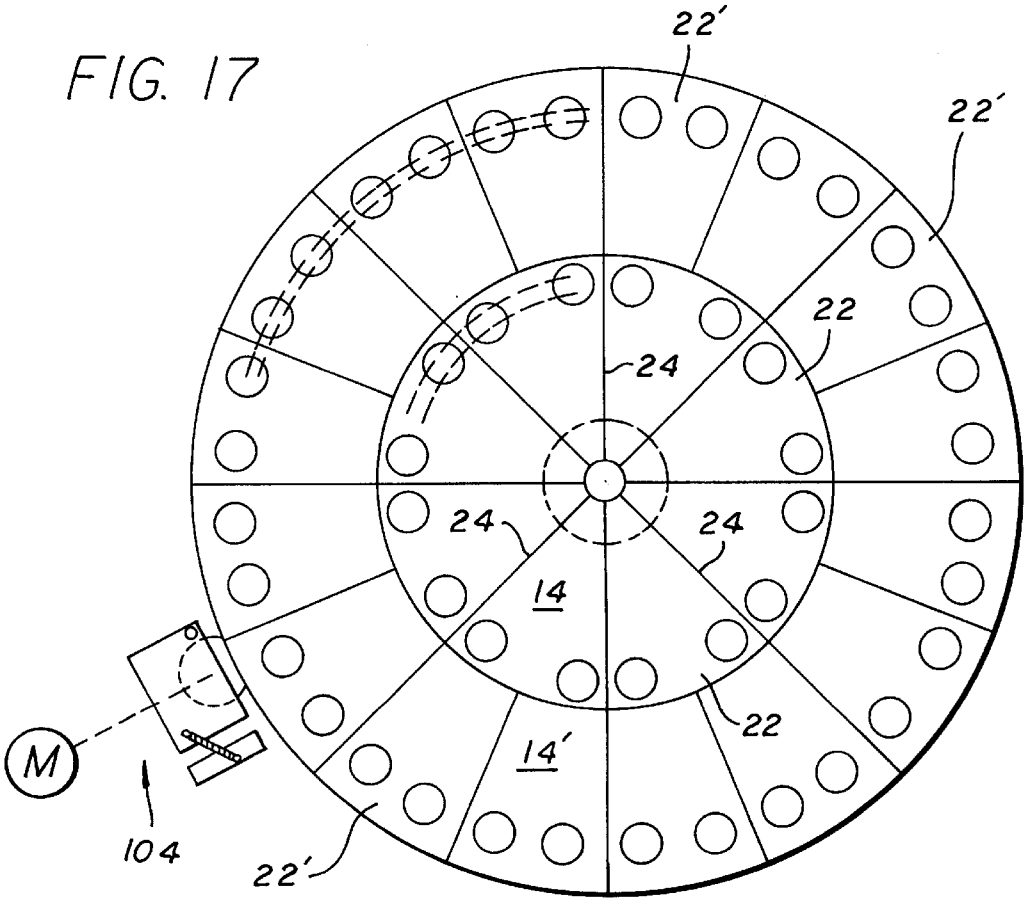
FIG. 17 is a top plan view, shown somewhat in schematic form, illustrating a further alternative preferred form of the invention.

The improved modular turntable 10 of the present invention may be constructed in a variety of diametric sizes by employing panel units in concentric rings, as shown by way of example in FIG. 17. In this regard, standard modular components may be preconstructed and adapted for interconnection along radial lines of separation 24 by multiple wheel units, of the type previously described. The panel units 22 as previously described are assembled to form an innermost turntable ring defining a flow surface area 14. An additional plurality of panel units 22' can be provided for assembly to form one or more outer annular floor surfaces 14'. Such outer ring panel units 22' will preferably be provided in a ratio of two outer units 22' for each inner unit 22. As shown, the outer units 22' include wheel units disposed adjacent the outer periphery thereof, such as in the manner described with respect to FIGS. 2–4. The illustrative outer panel units 22' may be securely fastened to the inner turntable structure by means of appropriate bolts (not shown) extending between the rim beams 35 of the inner units and corresponding structural beams at the inner periphery of the outer units. The traction drive surface 108 is installed on the outermost periphery of the thus-assembled turntable, to provide the rotatable drive means.

The assembled turntable 10, in any one of it various embodiments, thus provides a modular and easily assembled structure having a low profile compatible with standard building construction requirements. The lightweight nature of the modular components, in combination with the shared load distribution obtained by the wheel pairs mounted along inter-module lines of separation, permits use of the turntable in virtually any building structure without requiring major structural revisions or renovations. In use, the modular character of the assembled panel units interconnected along the radial lines of separation provides a beneficial degree of turntable flexibility or compliance to accommodate minor deviations in the horizontal plane of the substrate 20 without interfering with smooth-running turntable displacement and inter-panel shared load distribution by the dual-wheel units 26. The bearing support plates 87 (FIG. 10) and 100 (FIG. 11) accommodate this minor flex motion of the assembled turntable, without providing a sensation of significant bending or instability. Moreover, the turntable is installed with minimal affixation to the building structure, thereby permitting subsequent disassembly and removal of the turntable, if desired, with minimal disruption to the building.

A variety of further modifications and improvements to the modular turntable 10 of the present invention will be apparent to those skilled in the art. Accordingly, no limitation is intended by way of the foregoing description and accompanying drawings, except as set forth in the appended claims.

What is claimed is:

1. A turntable for installation into building, comprising:

a plurality of modular generally pie-shaped panel units adapted for assembly to cooperatively define a rotatable floor surface of generally circular shape, wherein each of said panel units is disposed between an adjacent pair of panel units and separated therefrom along radial lines of separation;

means for interconnecting each adjacent pair of said panel units along the radial line of separation therebetween, said interconnecting means for each adjacent pair of said panel units comprising at least one wheel unit having a wheel bracket connected to said adjacent pair of panel units, and a pair of support wheels carried by said wheel bracket and mounted on opposite sides of said radial line of separation for shared load distribution of said adjacent pair of panel units and loads carried thereby said adjacent pair of panel units being incapable of disassembly when said wheel unit is connected thereto; and center hearing means for rotatably supporting the assembled panel units for rotation about a central vertical axis.

2. The turntable of claim 1 wherein each of said panel units has a skeletal frame construction with a floor skin on an upper side thereof, said floor skin of each of said panel units cooperatively defining said rotatable floor surface when said panel units are assembled.

3. The turntable of claim 1 further including means for elevationally adjusting each of said support wheels.

4. The turntable of claim 1 wherein each pair of said support wheels is mounted in a position nested substantially within said adjacent pair of said panel units.

5. The turntable of claim 1 wherein said interconnecting means further includes keyway means for interconnecting each adjacent pair of said panel units to prevent substantial relative vertical displacement therebetween.

6. The turntable of claim 1 wherein said interconnecting means further includes clamp means for interconnecting each adjacent pair of said panel units to prevent substantial relative vertical displacement therebetween.

7. The turntable of claim 1 further including a circular wheel track for rolling support of said support wheels on said wheel units.

8. The turntable of claim 7 wherein said wheel track defines an annular wheel support surface, and includes means for elevationally adjusting said wheel support surface.

9. The turntable of claim 7 further including means for structurally connecting said wheel track with said center bearing means.

10. The turntable of claim 1 wherein said center bearing means includes means for elevationally adjusting the orientation of said assembled panel units.

11. The turntable of claim 1 wherein said modular panel units are identical.

12. The turntable of claim 1 wherein said modular panel units are assembled in concentric rings to provide an extended rotatable floor surface.

13. The turntable of claim 1 wherein each of said panel units includes a pair of radially extending support beams at opposite side edges thereof, and further wherein said wheel bracket of said at least one wheel unit is connected to adjacent radial support beams of said adjacent pair of panel units.

14. The turntable of claim 13 wherein said wheel bracket has a generally U-shaped construction defining a cavity for seated reception of said adjacent radial support beams.

15. The turntable of claim 14 further including means for fixedly securing said wheel bracket to said adjacent radial support beams.

16. A turntable for installation into a building, comprising:

a plurality of modular generally pie-shaped panel units adapted for assembly to cooperatively define a rotatable floor surface of generally circular shape, wherein each of said panel units is disposed between an adjacent pair of panel units and separated therefrom along radial lines of separation;

means for interconnecting each adjacent pair of said panel units along the radial line of separation therebetween, said interconnecting means for each adjacent pair of said panel units comprising a pair of support wheels mounted on opposite sides of said radial line of separation for shared load distribution of said adjacent pair of panel units and loads carried thereby;

center bearing means for rotatably supporting the assembled panel units for rotation about a central vertical axis;

said rotatable floor surface defining a peripheral edge; and drive means for rotatable driving said assembled panel units about said central vertical axis, said drive means including a drive roller in bearing engagement with said peripheral edge.

17. The turntable of claim 16 further including a traction drive tread mounted removably on said peripheral edge for bearing engagement by said drive roller.

18. A turntable for installation into a building, comprising:

a plurality of modular generally pie-shaped panel units each having a skeletal frame construction including a pair of radially extending support beams at opposite side edges thereof;

means for interconnecting said panel units in side-by-side array to form a generally circular turntable defining a rotatable floor surface of generally circular shape, wherein each of said panel units is disposed between an adjacent pair of panel units and separated therefrom along radial lines of separation;

said interconnecting means comprising a plurality of wheel units each for interconnecting an adjacent pair of said panel units along the radial line of separation therebetween, each of said wheel units including a wheel bracket for connection to adjacent radial support beams of said adjacent pair of panel units, and each of said wheel units further including a pair of support wheels carried by said wheel bracket on opposite sides of said radial line of separation for shared load distribution of said adjacent pair of panel units, said adjacent panel units being incapable of disassembly when said wheel unit is connected thereto;

center bearing means for rotatably supporting the assembled panel units for rotation about a central vertical axis; and drive means for rotatably driving said assembled panel units about said central vertical axis.

19. The turntable of claim 18 wherein each of said wheel units includes means for elevationally adjusting each of said associated support wheels.

20. The turntable of claim 18 wherein each of said wheel units is mounted in a position nested substantially within said adjacent pair of said panel units.

21. The turntable of claim 18 further including a circular wheel track for rolling support of said support wheels on said wheel units.

22. The turntable of claim 21 wherein said wheel track defines an annular wheel support surface, and includes means for elevationally adjusting said wheel support surface.

23. A turntable for installation into a building, comprising:

a plurality of modular generally Pie-shaped panel units each having a skeletal frame construction including a pair of radially extending support beams at opposite side edges thereof;

means for interconnecting said panel units in side-by-side array to form a generally circular turntable defining a rotatable floor surface of generally circular shape, wherein each of said panel units is disposed between an adjacent pair of panel units and separated therefrom along radial lines of separation;

said interconnecting means comprising a plurality of wheel units each for interconnecting an adjacent pair of said panel units along the radial line of separation therebetween, each of said wheel units including a wheel bracket for connection to adjacent radial support beams of said adjacent pair of panel units, and each of said wheel units further including a pair of support wheels carried by said wheel bracket on opposite sides of said radial line of separation for shared load distribution of said adjacent pair of panel units;

center bearing means for rotatable supporting the assembled panel units for rotation about a central vertical axis; and drive means for rotatably driving said assembled panel units about said central vertical axis;

wherein said rotatable floor surface defines a peripheral edge, and further wherein said drive means includes a drive roller in bearing engagement with said peripheral edge.

24. The turntable of claim 23 further including a traction drive tread mounted removably on said peripheral edge for bearing engagement by said drive roller.

25. A turntable for installation into a building, comprising:

a plurality of modular generally pie-shaped panel units adapted for assembly to cooperatively define a rotatable floor surface of generally circular shape, wherein each of said panel units is disposed between an adjacent pair of panel units and separated therefrom along radial lines of separation;

means for interconnecting each adjacent pair of said panel units along the radial line of separation therebetween, said interconnecting means for each adjacent pair of said panel units comprising at least one wheel unit having a wheel bracket connected to said adjacent pair of said panel units, and a pair of support wheels carried by said wheel bracket on opposite sides of said radial line of separation for shared load distribution of said adjacent pair of panel units and loads carried thereby, said adjacent pair of panel units being incapable of disassembly when said wheel unit is connected thereto;

center bearing mans for rotatably supporting the assembled panel units for rotation about a central vertical axis;

track means defining a elevationally adjustable wheel support surface for rolling support of said support wheels of said wheel units;

means for connecting said track means to said center bearing means to retain said track support surface in a predetermined position relative to said assembled panel units; and drive means for rotatably driving said assembled panel units about said central vertical axis.

26. The turntable of claim 25 wherein each of said wheel units includes means for elevationally adjusting each of said associated support wheels.

27. The turntable of claim 25 wherein each of said wheel units is mounted in a position nested substantially within said adjacent pair of said panel units.

28. A turntable for installation into a building, comprising:

a plurality of modular generally pie-shaped panel units adapted for assembly to cooperatively define a rotatable floor surface of generally circular shape, wherein each of said panel units is disposed between an adjacent pair of panel units and separated therefrom alone radial lines of separation;

means for interconnecting each adjacent pair of said panel units along the radial line of separation therebetween, said interconnecting means for each adjacent pair of said panel units comprising at least one wheel unit having a wheel bracket connected to said adjacent pair of said panel units, and a pair of support wheels carried by said wheel bracket on opposite sides of said radial line of separation for shared load distribution of said adjacent pair of panel units and loads carried thereby;

center bearing means for rotatable supporting the assembled panel units for rotation about a central vertical axis;

track means defining an elevationally adjustable wheel support surface for rolling support of said support wheels of said wheel units;

means for connecting said track means to said center bearing means to retain said track support surface in a predetermined position relative to said assembled panel units; and drive means for rotatable driving said assembled panel units about said central vertical axis;

wherein said rotatable floor surfaces defines a peripheral edge and further wherein said drive means includes a drive roller in bearing engagement with said peripheral edge.

29. The turntable of claim 28 further including a traction drive tread mounted removably on said peripheral edge for bearing engagement by said drive roller.

30. A turntable for installation into a building, comprising:

a plurality of generally pie-shaped panel units adapted for assembly to cooperatively define a rotatable floor surface of generally circular shape, and wherein each of said panel units is disposed between an adjacent pair of panel units and separated therefrom along radial lines of separation;

means for interconnecting each adjacent pair of said panel units along the radial line of separation therebetween, said interconnecting means for each adjacent pair of said panel units comprising a wheel bracket connected to said adjacent pair of panel units, said wheel bracket having at least one support wheel for supporting said adjacent pair of panel units and loads carried thereby, said adjacent pair of panel units being incapable of disassembly when said wheel bracket is connected thereto; and center bearing means for rotatably supporting the assembled panel units for rotation about a central vertical axis.

31. A turntable for installation into a building, comprising:

a turntable unit defining an upwardly presented turntable surface area with a peripheral edge, said turntable unit having an underside surface with a plurality of support wheels mounted thereon in a generally annular array;

center bearing means for rotatably supporting the turntable unit for rotation about a central vertical axis; and seismic tie-down means for preventing substantial vertical upward displacement of said turntable unit at said peripheral edge, relative to the building, said seismic tie-down means being disposed below said upwardly presented turntable surface area.

32. A turntable for installation into a building, comprising:

a plurality of modular generally pie-shaped panel units adapted for assembly to cooperatively define a rotatable floor surface of generally circular shape, wherein each of said panel units is disposed between an adjacent pair of panel units and separated therefrom along radial lines of separation;

means for interconnecting each adjacent pair of said panel units along the radial line of separation therebetween, said interconnecting means for each adjacent pair of said panel units comprising a pair of support wheels mounted on opposite sides of said radial line of separation for shared load distribution of said adjacent pair of panel units and loads carried thereby; and center bearing means for rotatably supporting the assembled panel units for rotation about a central vertical axis and about a vertical column in a building;

said center bearing means comprising an annular bearing ring connected to said panel units and adapted for mounting about a vertical column in a building, and a circumferential array of bearing means for engaging an outer margin of said bearing ring.

33. A turntable for installation into a building, comprising:

a plurality of modular generally pie-shaped panel units adapted for assembly to cooperatively define a rotatable floor surface of generally circular shape, wherein each of said panel units is disposed between an adjacent pair of panel units and separated therefrom along radial lines of separation;

means for interconnecting each adjacent pair of said panel units along the radial line of separation therebetween, said interconnecting means for each adjacent pair of said panel units comprising a pair of support wheels mounted on opposite sides of said radial line of separation for shared load distribution of said adjacent pair of panel units and loads carried thereby; and center bearing means for rotatably supporting the assembled panel units for rotation about a central vertical axis, said rotatable floor surface defining a peripheral edge and further including seismic tie-down means disposed below said rotatable floor surface for preventing substantial vertical upward displacement of said assembled panel units at said peripheral edge thereof, relative to the building.

34. A turntable for installation into a building, comprising:

a plurality of modular generally pie-shaped panel units adapted for assembly to cooperatively define a rotatable floor surface of generally circular shape, wherein each of said panel units is disposed between an adjacent pair of panel units and separated therefrom along radial lines of separation;

means for interconnecting each adjacent pair of said panel units along the radial line of separation therebetween, said interconnecting means for each adjacent pair of said panel units permitting flex movement of said adjacent pair of panel units along said radial line of separation therebetween;

each adjacent pair of said panel units further including at least one wheel unit connected thereto generally along said radial line of separation therebetween for shared load distribution of said adjacent pair of panel units and loads carried thereby; and center bearing means for rotatably supporting the assembled panel units for rotation about a central vertical axis.

35. The turntable of claim 34 wherein said at least one wheel unit comprises a pair of support wheels mounted on opposite sides of said radial line of separation.

* * * * *